US010945319B1

(12) United States Patent
McRae

(10) Patent No.: US 10,945,319 B1
(45) Date of Patent: Mar. 9, 2021

(54) SYSTEM, APPARATUS, AND METHOD FOR CONTROLLING LIGHTING

(71) Applicant: National Christmas Products LLC, Cranford, NJ (US)

(72) Inventor: Michael M. McRae, Ormond Beach, FL (US)

(73) Assignee: National Christmas Products LLC, Cranford, NJ (US)

( * ) Notice: Subject to any disclaimer, the term of this patent is extended or adjusted under 35 U.S.C. 154(b) by 0 days.

(21) Appl. No.: 16/722,448

(22) Filed: Dec. 20, 2019

(51) Int. Cl.

| | |
|---|---|
| ***H05B 45/00*** | (2020.01) |
| ***H05B 45/3725*** | (2020.01) |
| ***F21S 4/10*** | (2016.01) |
| ***H05B 45/20*** | (2020.01) |
| *F21W 121/04* | (2006.01) |

(52) U.S. Cl.
CPC ..... *H05B 45/3725* (2020.01); *F21S 4/10* (2016.01); *H05B 45/20* (2020.01); *F21W 2121/04* (2013.01)

(58) Field of Classification Search
CPC ..... H05B 33/0815; H05B 33/0827; H05B 33/0839; H05B 33/0845; H05B 33/0857; H05B 45/10; H05B 45/20; H05B 45/42; H05B 45/52; H05B 45/54
USPC ..... 315/192, 193
See application file for complete search history.

(56) References Cited

U.S. PATENT DOCUMENTS

| | | | | |
|---|---|---|---|---|
| 4,215,277 | A * | 7/1980 | Weiner | H05B 47/155 307/41 |
| 8,106,599 | B2 * | 1/2012 | Radermacher | H05B 45/20 315/291 |
| 8,941,312 | B2 * | 1/2015 | McRae | H05B 45/37 315/193 |
| 8,988,013 | B2 * | 3/2015 | McRae | H05B 45/22 315/313 |
| 2008/0116816 | A1 * | 5/2008 | Neuman | F21S 4/10 315/185 S |
| 2010/0141161 | A1 * | 6/2010 | Hering | F21S 4/10 315/185 S |
| 2010/0320920 | A1 * | 12/2010 | Cheng | F21S 8/00 315/185 R |
| 2014/0333859 | A1 * | 11/2014 | Zhang | G02B 30/00 349/15 |
| 2015/0359066 | A1 * | 12/2015 | Loomis | H05B 45/00 362/123 |

(Continued)

*Primary Examiner* — Tung X Le
(74) *Attorney, Agent, or Firm* — Ellenoff Grossman & Schole LLP; James M. Smedley; Alex Korona

(57) ABSTRACT

An apparatus is disclosed. The apparatus has a controller, a main power source, an electrical converter configured to receive a first electrical signal from the main power source, and a capacitor electrically connected to the electrical converter. The apparatus also has an electrical selector switch electrically connected to at least one of the electrical converter and the capacitor, an electrical driver electrically connected to the electrical selector switch, at least one electrical output component electrically connected to the electrical driver, and at least one electrical component that is configured to receive a second electrical signal via the at least one electrical output component. The controller controls an operation of the at least one electrical component based on the second electrical signal, independently of control of the first electrical signal.

20 Claims, 11 Drawing Sheets

(56) References Cited

U.S. PATENT DOCUMENTS

2017/0257924 A1* 9/2017 Leung ..... F21V 23/02
2018/0376566 A1* 12/2018 Newton ..... H05B 47/19

* cited by examiner

SYSTEM, APPARATUS, AND METHOD FOR CONTROLLING LIGHTING

TECHNICAL FIELD

The present disclosure generally relates to a system, apparatus, and method for lighting, and more particularly to a system, apparatus, and method for controlling lighting.

BACKGROUND

Many seasonal decorations are illuminated by lighting strings having multiple current directions or multiple wires with individual current power sources having a common return. Such conventional lighting systems typically have a varying voltage of current to control lighting effects of bulbs of the lighting strings. Some examples include dual-color white and multi-color Christmas lighting strings or 4-wire, 3 power leads that each control one color of an LED of a common bulb with a single return wire. These conventional systems can provide a variety of colors and shades by varying color signals to the individual LED colors either individually (singly) or in combinations.

Some conventional LED systems may also be connected in place of incandescent bulbs in a string of incandescent bulbs. However, these systems are controlled to light up using the power of the lighting string. Also, conventional systems that are powered by a main lighting string follow the commands of the main lighting string. Accordingly, control of conventional systems is limited by the control of a main lighting string.

The exemplary disclosed system, apparatus, and method are directed to overcoming one or more of the shortcomings set forth above and/or other deficiencies in existing technology.

SUMMARY OF THE DISCLOSURE

In one exemplary aspect, the present disclosure is directed to an apparatus. The apparatus includes a controller, a main power source, an electrical converter configured to receive a first electrical signal from the main power source, and a capacitor electrically connected to the electrical converter. The apparatus also includes an electrical selector switch electrically connected to at least one of the electrical converter and the capacitor, an electrical driver electrically connected to the electrical selector switch, at least one electrical output component electrically connected to the electrical driver, and at least one electrical component that is configured to receive a second electrical signal via the at least one electrical output component. The controller controls an operation of the at least one electrical component based on the second electrical signal, independently of control of the first electrical signal.

In another exemplary aspect, the present disclosure is directed to a method. The method includes providing a first electrical signal from a main power source to an electrical converter, converting the first electrical signal to a second electrical signal using the electrical converter, smoothing the second electrical signal using a capacitor electrically connected to the electrical converter, and transferring the smoothed second electrical signal to at least one electrical output component via an electrical selector switch electrically connected to the capacitor and via an electrical driver electrically connected to the electrical selector switch. The method also includes transferring the smoothed second electrical signal to at least one electrical component via the at least one electrical output component, controlling the first electrical signal, and controlling an operation of the at least one electrical component based on the smoothed second electrical signal, independently of controlling the first electrical signal.

DETAILED DESCRIPTION AND INDUSTRIAL APPLICABILITY

The exemplary disclosed system, apparatus, and method may provide a lighting system that may be powered by a main lighting source and may include lighting components that may be controlled independently of the main lighting source. For example, the exemplary disclosed system, apparatus, and method may power color-controlled lighting components (e.g., decorations such as decorative lighting) using low-voltage, multiple-current lighting sources (e.g., light strings such as LED light strings).

In at least some exemplary embodiments, the exemplary disclosed system may include one or more illuminated ornaments that may be powered by a main light string source while the illuminated ornaments are operated and/or controlled independently (e.g., the one or more illuminated ornaments controls itself and does not follow commands of the main light string source such as an LED light string or an incandescent light string).

In at least some exemplary embodiments, holiday ornaments (e.g., Christmas ornaments) may be connected to one or more LED common power sources (e.g., one or more LED lighting strings). The exemplary disclosed system may rectify a variety of current sources and current directions to a single DC output using a smoothing capacitor to maintain power levels (e.g., between loss or reduction of current power as the one or more common power sources change current, e.g., "fading" and/or "blinking," and/or vary current and/or color levels).

In at least some exemplary embodiments, the exemplary disclosed system may include an output that may be a single fixed current and current direction. The output may also be a varying output to a single set of dual color LEDs disposed in one or more ornaments. The output may also be a variety of current sources with multiple power and current levels provided to the ornaments. The exemplary disclosed output may be operated remotely from main power sources such as LED lighting strings.

In at least some exemplary embodiments, the exemplary disclosed system may include lighting components (e.g., ornaments) that derive their power from a main lighting source (e.g., LED lighting string having multiple current sources and/or current directions). For example, the lighting components may tap off of a power LED cable of the main lighting source. A converter and/or controller may convert the power to DC power and provide independent illumination control to the lighting components (e.g., ornaments).

Figure 1:
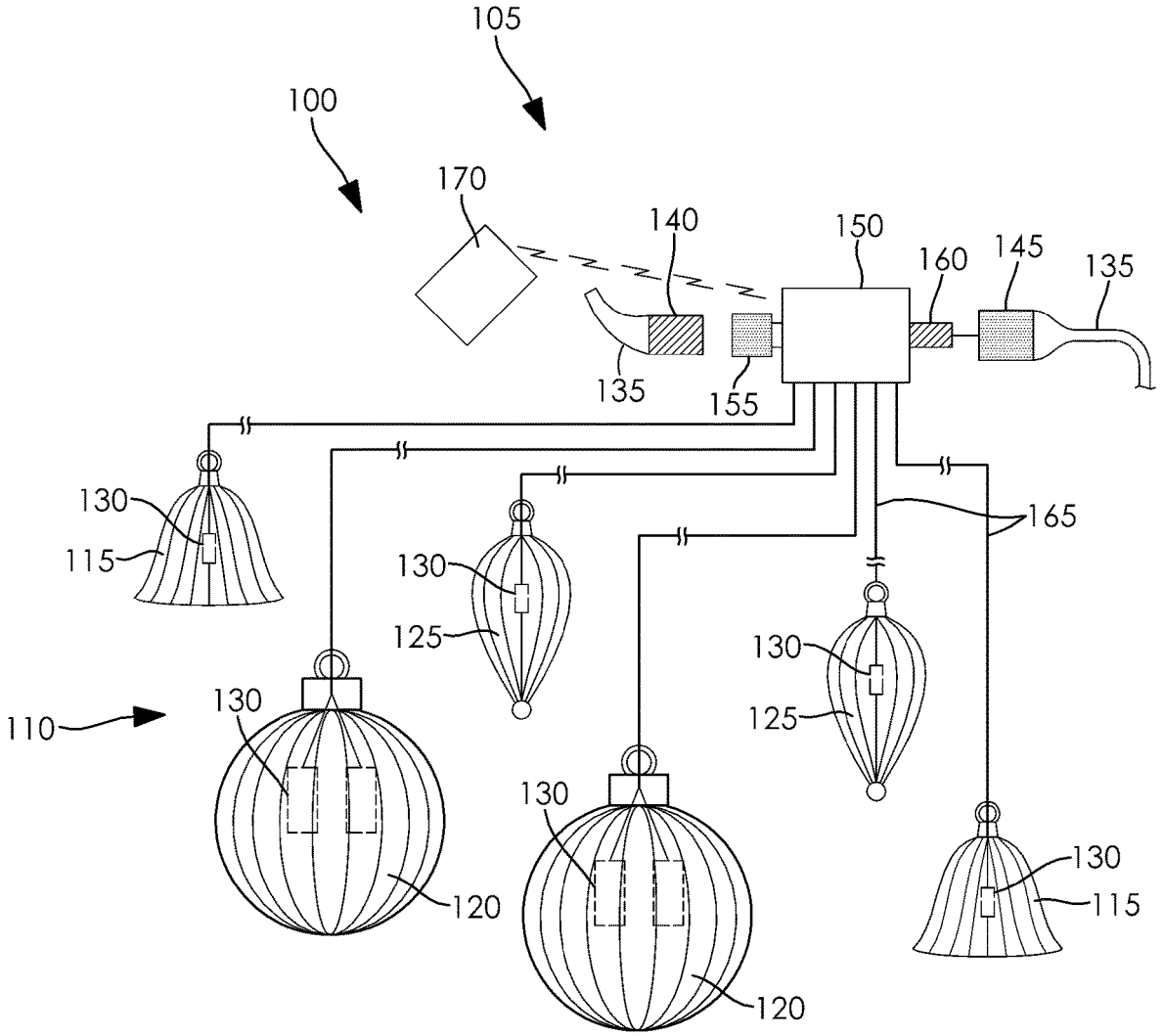
FIG. 1 illustrates a schematic view of at least some exemplary embodiments of the present disclosure.

FIG. 1 illustrates an exemplary system 100. System 100 may be a decorative lighting system such as a decorative holiday light system. Exemplary system 100 may include a power assembly 105 and a decorative system 110. Power assembly 105 may provide power (e.g., electrical power) to decorative system 110.

Decorative system 110 may include a plurality of electrical components. The electrical components may be for example holiday decorations (e.g., ornaments). For example, the electrical components may be any suitable type of illuminated decoration such as illuminated ornaments, illuminated bows disposed on wreaths, decorative assemblies including fiber optic assemblies attached to output LEDs, or any other suitable electrical component. For example as illustrated in FIG. 1, decorative system 110 may include one or more electrical components 115 such as a bell or bell-shaped ornament, one or more electrical components 120 such as a ball or ball-shaped ornament, and/or one or more electrical components 125 such as a tear or tear-shaped ornament. The exemplary disclosed electrical components (e.g., electrical components 115, 120, and/or 125) may include one or more lighting components 130 that may be disposed on, completely within, and/or partially within the electrical components. Lighting component 130 may include a light-emitting diode (LED), an incandescent bulb, and/or any other suitable lighting component for use in system 100 such as a decorative lighting display. Lighting component 130 may illuminate the exemplary disclosed electrical components (e.g., electrical components 115, 120, and/or 125). Lighting component 130 may alternatively be an audio component or other electrical component for providing a desired operation to the exemplary disclosed electrical component (e.g., lighting, sound, internet or Wi-Fi capability, computer system, and/or any other desired electronic function).

Power assembly 105 may include a power connector 135. Power connector 135 may be a main power source for powering lighting components 130. For example, power connector 135 may be a main lighting source. In at least some exemplary embodiments, power connector 135 may be an LED string cable of an LED light string (e.g., when system 100 includes an LED light string). Power connector 135 may also be an incandescent light string. Power connector 135 may transfer any desired level of voltage such as relatively low voltage (e.g., between about 24V and about 31V of DC electricity). Power connector 135 may also be a multiple-current lighting source. Power connector 135 may include one or more connectors (e.g., connector 140 and connector 145) for connecting to other components of power assembly 105 for example as described below. Connectors 140 and 145 may be any suitable electrical connector such as a screw-down connector, plug-in connector, pin connector, or any other suitable electrical connector.

Power assembly 105 may include a converter 150. Converter 150 may be connected to power connector 135 via connectors 155 and 160 that may be similar to connectors 140 and 145. Connector 140 may be attached to connector 155, and connector 145 may be attached to connector 160, so that converter 150 may be electrically connected to power connector 135. A plurality of converters 150, each having one or more exemplary disclosed electrical components, may be electrically connected to power connector 135.

Converter 150 may include a converter and controller device as described further herein. Converter 150 may also include a capacitor (e.g., a smoothing capacitor) as described further herein. Converter 150 may convert electricity provided by power connector 135 to DC (direct current) power. For example, AC (alternating current) electricity provided by power connector 135 may be converted to DC electricity by converter 150 and provided to one or more exemplary disclosed electrical components (e.g., electrical components 115, 120, and/or 125) via one or more electrical members 165 (e.g., an electrical wire, an electrical cord, an electrical cable, and/or any other suitable member for transferring electricity). Converter 150 may also make any other suitable electrical conversion such as from DC electricity to AC electricity. For example, electrical members 165 may be ornament cables for transferring DC electricity to power one or more electrical components (e.g., electrical components 115, 120, and/or 125).

An operation of converter 150 may be controlled via remote control and/or via a controller included in converter 150. For example as illustrated in FIG. 1, a controller 170 may be disposed remotely from power assembly 105 (or may be partially or substantially entirely included in converter 150) and may control an operation of converter 150 (e.g., via transmitter and receiver components included in converter 150 and controller 170). Controller 170 may include for example a processor (e.g., micro-processing logic control device) or board components. Controller 170 may include input/output arrangements that allow it to be connected (e.g., via wireless and/or electrical connection such as wires or electrical lines) to other components of system 100. For example, controller 170 may control an operation of system 100 based on user input received from one or more user interfaces (e.g., interfaces of system 100), computer modules (e.g., in wireless and/or direct connection to system 100), and/or user devices (e.g., such as smartphones or tablets having applications for use with system 100). Controller 170 may be a separate controller or may be integrated into one or more components of system 100.

Figure 2:
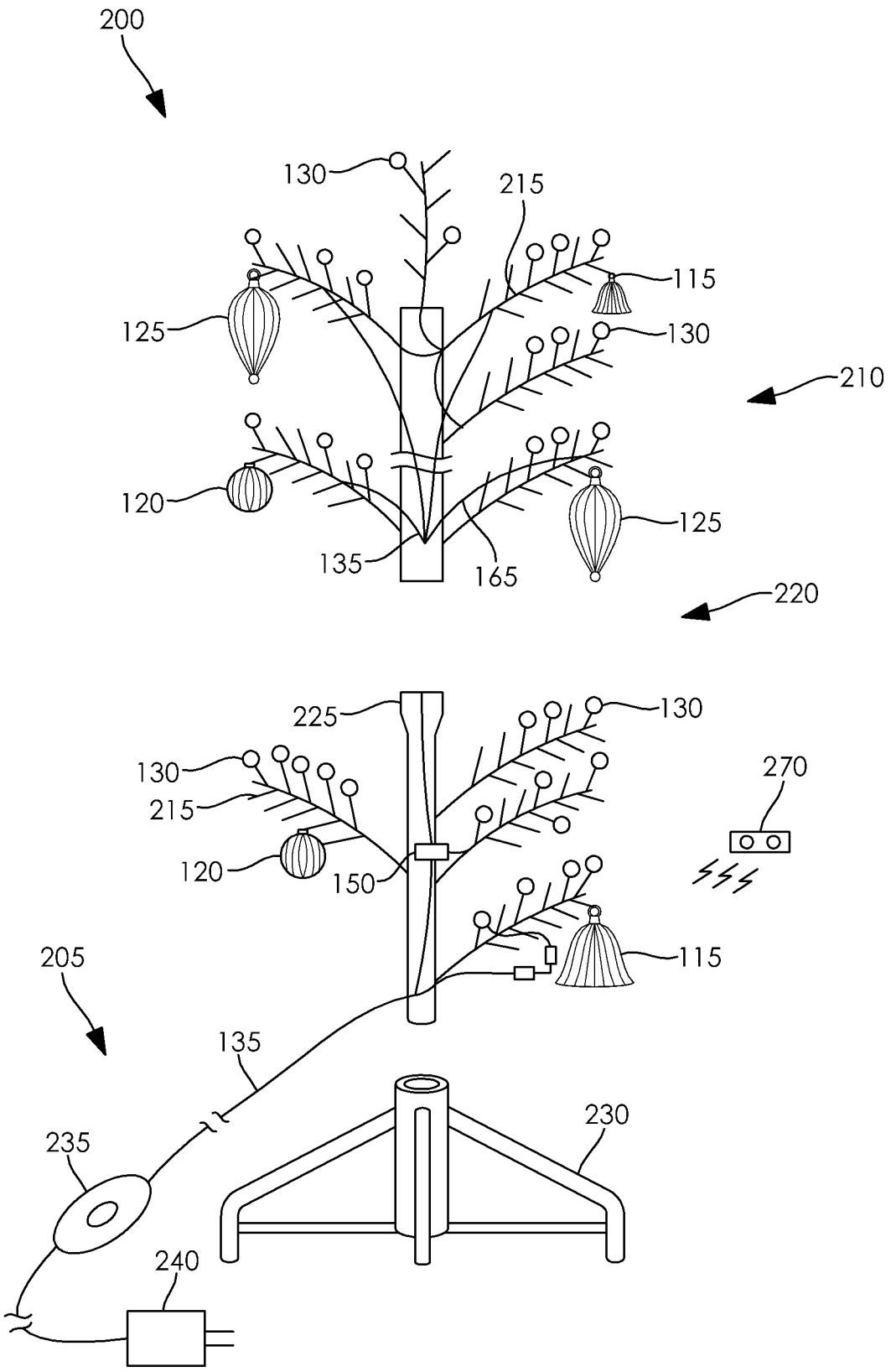
FIG. 2 illustrates an exploded view of at least some exemplary embodiments of the present disclosure.

FIG. 2 illustrates another exemplary embodiment of the exemplary disclosed system. System 200 may include one or more power assemblies 205 that may be similar to power assembly 105 and one or more decorative systems 210 that may be similar to decorative system 110. Decorative system 210 may include a plurality of electrical components (e.g., electrical components 115, 120, and/or 125) including lighting components 130. The plurality of electrical components (e.g., electrical components 115, 120, and/or 125) may be disposed on a plurality of members 215 of a support structure 220 (e.g., any suitable decorative structure). For example, members 215 may be artificial tree branches of support structure 220 that may be an artificial Christmas tree. Members 215 may be supported by a structural assembly 225 that may be a tree pole assembly that may be supported by a support assembly 230 (e.g., a tree stand). Decorative system 210 may also include a plurality of individual lighting components 130 that may be disposed on one or more members 215 (e.g., tree branches).

Power assembly 205 may include a plurality of electrical members 165 that may electrically connect lighting components 130 to one or more converters 150. The one or more converters 150 may be electrically connected to power connector 135 as described for example above. Power connector 135 may also be attached to an electrical component 235 and an electrical component 240 (e.g., an electrical plug that may be connected to an electrical power source such as a wall socket). Electrical component 235 may be any suitable component for controlling an operation of system 200 such as, for example, a housing including switches that may be actuated by a user. For example, electrical component 235 may be a foot pedal including push-button switches. Electrical component 240 may provide any desired current and voltage to system 200 such as any desired current and voltage of AC and/or DC electricity. In at least some exemplary embodiments, electrical component 240 may be an AC/DC, HI/LO adapter. Power assembly 205 may also include a controller 270 that may be similar to controller 170 and may remotely control an operation of system 200.

In at least some exemplary embodiments, support structure 220 may be an artificial or live Christmas tree having Christmas ornaments (e.g., electrical components 115, 120, and/or 125) electrically connected to power connector 135 that may be an LED string. Electrical component 240 may selectively provide DC current to electrical component 235 that may be a foot switch. Electrical component 235 may have control settings that allow for varied current direction and timing to power connector 135. Power connector 135 may be electrically connected to converter 150 to provide DC electricity and illumination control to decorative system 210 (e.g., to electrical components 115, 120, and/or 125).

Figure 3:
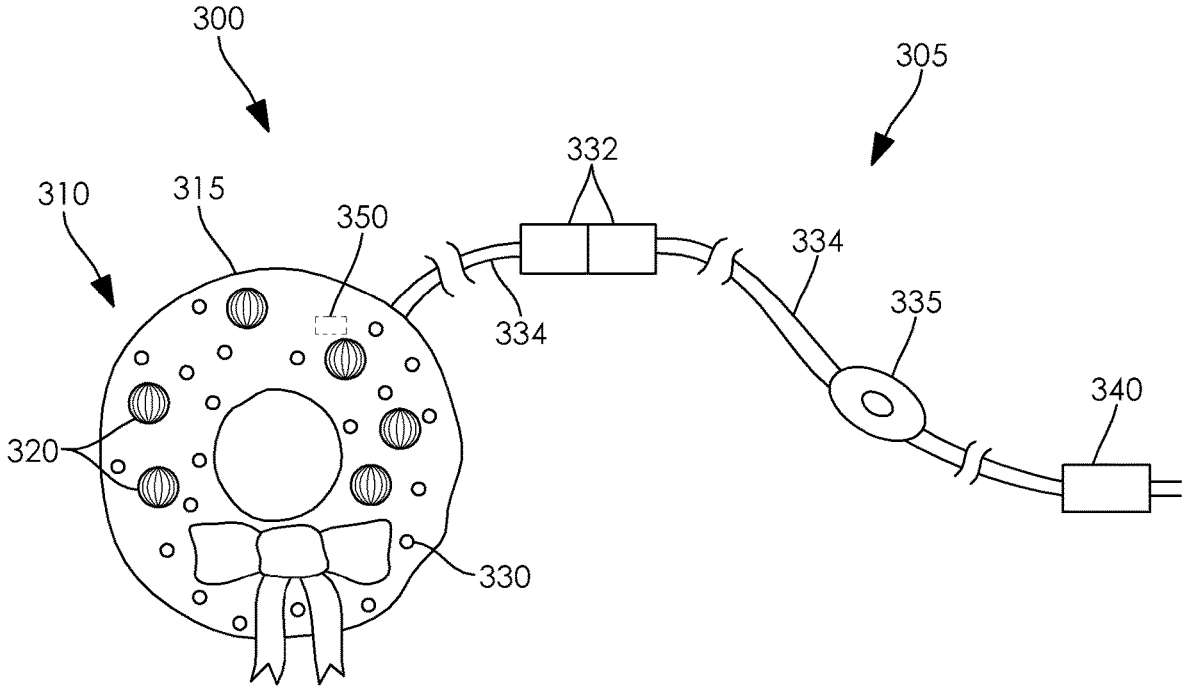
FIG. 3 illustrates a front view of at least some exemplary embodiments of the present disclosure.

FIG. 3 illustrates another exemplary embodiment of the exemplary disclosed system. System 300 may include one or more power assemblies 305 that may be similar to power assembly 105 and one or more decorative systems 310 that may be similar to decorative system 110.

Decorative system 310 may include a plurality of electrical components 320 that may be similar to electrical components 115, 120, or 125 and a plurality of lighting components 330 that may be similar to lighting components 130. In at least some exemplary embodiments, electrical component 320 may be a lighted LED ornament and lighting components 330 may be LEDs that may be disposed on a decorative assembly 315. Decorative assembly 315 may be any suitable decoration such as a holiday decoration (e.g., a wreath).

Power assembly 305 may include a converter 350 that may be similar to converter 150. Power assembly 305 may also include one or more power connectors 334 that may be similar to power connector 135. Power connectors 334 may be LED string cables that may be electrically connected to each other and to other components of system 300 via electrical connectors 332 that may be similar to connectors 140 and 145. Power assembly 305 may also include an electrical component 335 (e.g., an electronic switch) that may be similar to electrical component 235 and an electrical component 340 (e.g., an electrical plug that may be connected to an electrical power source such as a wall socket) that may be similar to electrical component 240.

Figure 4A:
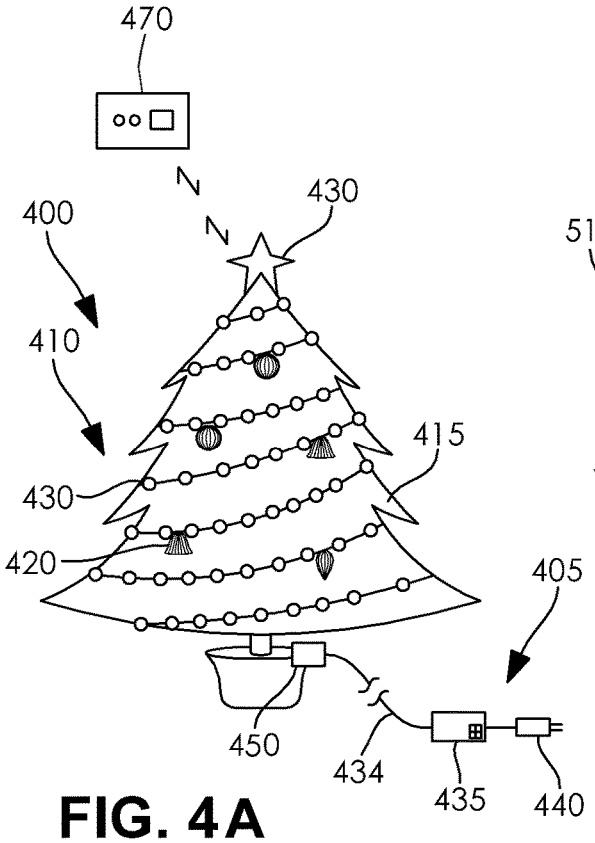
FIG. 4A illustrates a front view of at least some exemplary embodiments of the present disclosure.
Figure 4B:
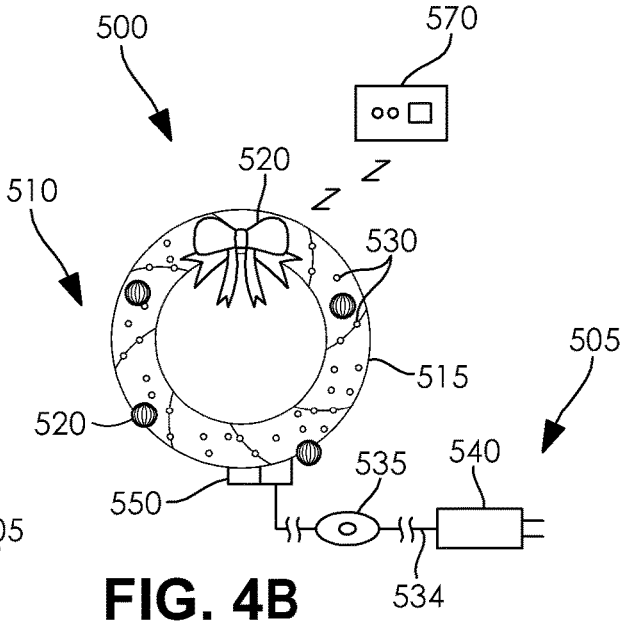
FIG. 4B illustrates a front view of at least some exemplary embodiments of the present disclosure.
Figure 4C:
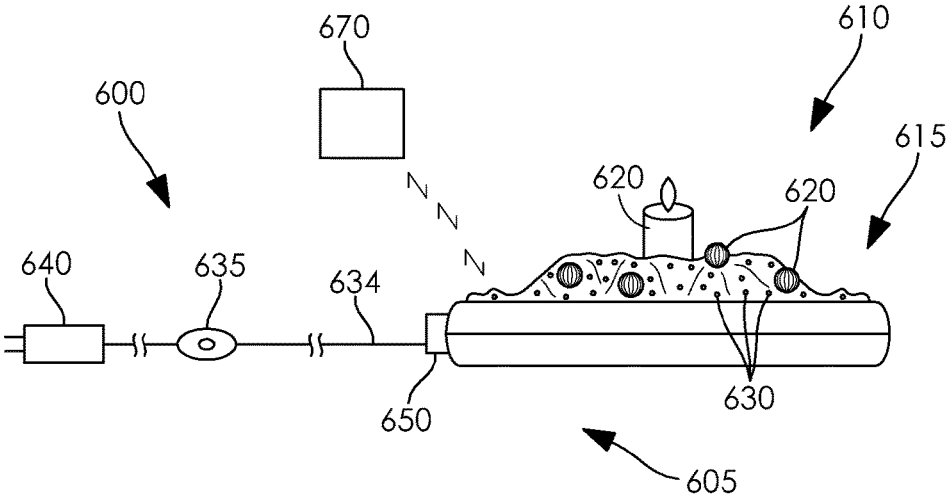
FIG. 4C illustrates a front view of at least some exemplary embodiments of the present disclosure.

FIGS. 4A, 4B, and 4C illustrate additional exemplary embodiments of the exemplary disclosed system. In these exemplary embodiments, color-changing lighted decorations (e.g., including LED and/or incandescent lighting elements) having separately controlled decorations (e.g., ornaments) may be provided on any suitable decorative assembly.

As illustrated in FIG. 4A, an exemplary system 400 may include one or more power assemblies 405 that may be similar to power assembly 105 and one or more decorative systems 410 that may be similar to decorative system 110.

Decorative system 410 may include a plurality of electrical components 420 that may be similar to electrical components 115, 120, or 125 and a plurality of lighting components 430 that may be similar to lighting components 130. In at least some exemplary embodiments, lighting component 430 may be a dual color LED that may be disposed on a decorative assembly 415. Decorative assembly 415 may be any suitable decoration such as a holiday decoration (e.g., an artificial tree). In at least some exemplary embodiments, electrical component 420 and/or lighting component 430 may be a dual color LED that may be a star or star-shaped ornament disposed at an upper portion of decorative assembly 415.

Power assembly 405 may include a converter 450 that may be similar to converter 150. Power assembly 405 may also include one or more power connectors 434 that may be similar to power connector 135. Power connectors 434 may be LED string cables that may be electrically connected to each other and to other components of system 400 via electrical connectors that may be similar to connectors 140 and 145. Power assembly 405 may also include an electrical component 435 that may be similar to electrical component 235. Electrical component 435 may be for example an electronic switch such as an LED color switch for controlling a display color of electrical components 420 and/or lighting components 430. Power assembly 405 may also include an electrical component 440 that may be similar to electrical component 240. In at least some exemplary embodiments, electrical component 440 may be an AC/DC, HI/LO adapter that may be connected to an AC power source. Power assembly 405 may also include a controller 470 that may be similar to controller 170 and may remotely control an operation of system 400.

As illustrated in FIG. 4B, an exemplary system 500 may include one or more power assemblies 505 that may be similar to power assembly 105 and one or more decorative systems 510 that may be similar to decorative system 110.

Decorative system 510 may include a plurality of electrical components 520 that may be similar to electrical components 115, 120, or 125 and a plurality of lighting components 530 that may be similar to lighting components 130. In at least some exemplary embodiments, lighting component 530 may be a dual color LED that may be disposed on a decorative assembly 515. Decorative assembly 515 may be any suitable decoration such as a holiday decoration (e.g., a holiday wreath). In at least some exemplary embodiments, electrical component 520 may be an LED bow or an ornament disposed on decorative assembly 515.

Power assembly 505 may include a converter 550 that may be similar to converter 150. Power assembly 505 may also include one or more power connectors 534 that may be similar to power connector 135. Power assembly 505 may also include an electrical component 535 that may be similar to electrical component 235. Electrical component 535 may be for example an electronic switch for controlling a display color of electrical components 520 and/or lighting components 530. Power assembly 505 may also include an electrical component 540 that may be similar to electrical component 240. In at least some exemplary embodiments, electrical component 540 may be an AC/DC, HI/LO adapter that may be connected to a power source (e.g., an electrical socket). Power assembly 505 may also include a controller 570 that may be similar to controller 170 and may remotely control an operation of system 500.

As illustrated in FIG. 4C, an exemplary system 600 may include one or more power assemblies 605 that may be similar to power assembly 105 and one or more decorative systems 610 that may be similar to decorative system 110.

Decorative system 610 may include a plurality of electrical components 620 that may be similar to electrical components 115, 120, or 125 and a plurality of lighting components 630 that may be similar to lighting components 130. In at least some exemplary embodiments, lighting component 630 may be a dual color LED that may be disposed on a decorative assembly 615. Decorative assembly 615 may be any suitable decoration such as a holiday decoration (e.g., a holiday centerpiece such as a holiday table centerpiece). In at least some exemplary embodiments, electrical component 620 may be an LED candle disposed on decorative assembly 615.

Power assembly 605 may also include a converter 650 that may be similar to converter 150. Power assembly 605 may also include one or more power connectors 634 that may be similar to power connector 135. Power assembly 605 may also include an electrical component 635 that may be similar to electrical component 235. Electrical component 635 may be for example an electronic switch for controlling and changing a display color of electrical components 620 and/or lighting components 630. Power assembly 605 may also include an electrical component 640 that may be similar to electrical component 240. In at least some exemplary embodiments, electrical component 640 may be an AC/DC, HI/LO adapter that may be connected to a power source. Power assembly 605 may also include a controller 670 that may be similar to controller 170 and may remotely control an operation of system 600.

Figure 5:
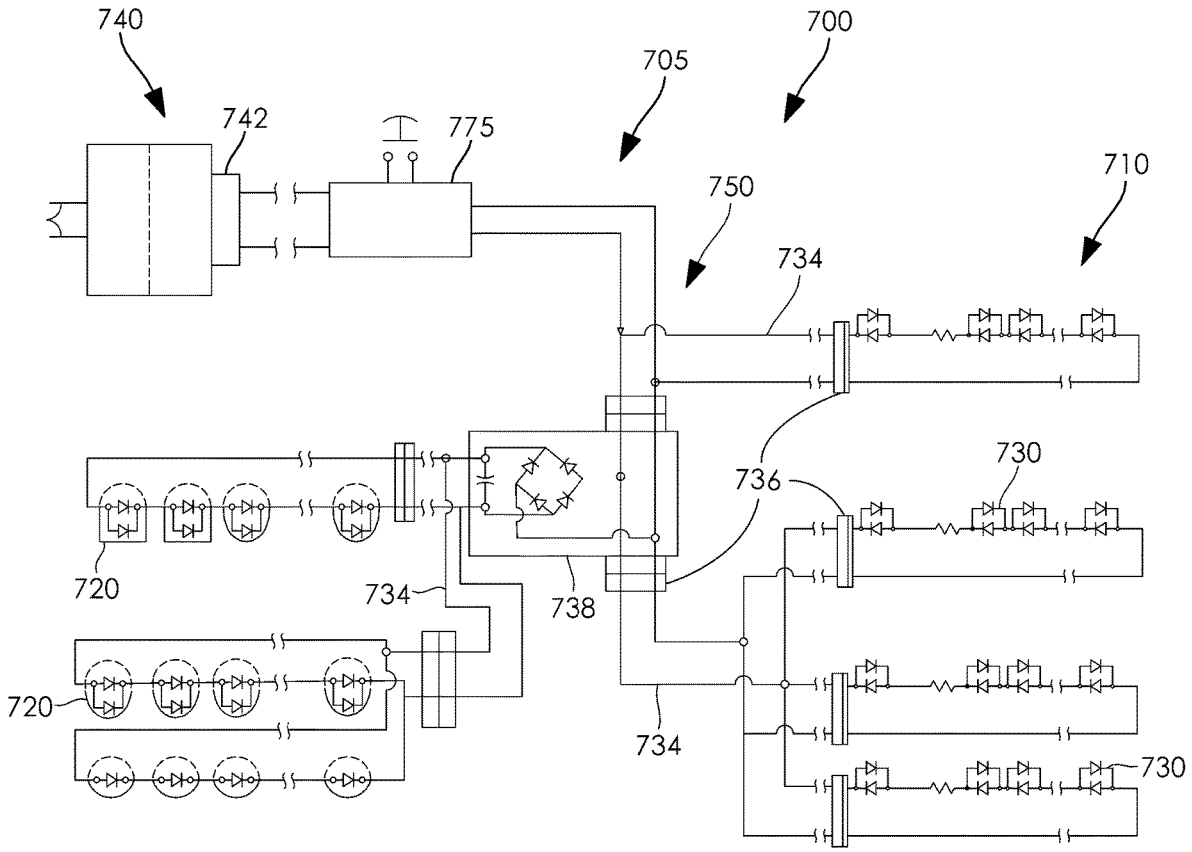
FIG. 5 illustrates a schematic view of at least some exemplary embodiments of the present disclosure.

FIG. 5 schematically illustrates an exemplary embodiment of an exemplary disclosed control and conversion system that may be included in at least some of the exemplary disclosed systems described above. As illustrated in FIG. 5, a system 700 may include one or more power assemblies 705 that may be similar to power assembly 105 and one or more decorative systems 710 that may be similar to decorative system 110.

Power assembly 705 may include a converter 750 that may be similar to converter 150. Converter 750 may include a control component 775, a capacitor 780, and an electrical bridge component 785. Electrical bridge component 785 may be electrically connected to control component 775 and capacitor 780. Converter 750 may also include an ornament converter 738 that may comprise capacitor 780 and electrical bridge component 785, which may convert electricity flowing to components of decorative system 710 as described for example herein.

Control component 775 may be electrically connected to an electrical component 740 that may be similar to electrical component 240 via a connector 742 that may be similar to connectors 140 and 145. In at least some exemplary embodiments, electrical component 740 may be an AC/DC, HI/LO power adapter that may be connected to a power source (e.g., an electrical socket). Control component 775 may be any suitable switching circuit such as a multi-function switching circuit. In at least some exemplary embodiments, control component 775 may be controlled remotely and/or directly by a controller similar to controller 170.

Electrical bridge component 785 may be any suitable component for electrically connecting (e.g., selectively electrically connecting) components of power assembly 705 and decorative system 710. For example, electrical bridge component 785 may be any suitable diode bridge such as a four-diode bridge. In at least some exemplary embodiments, electrical bridge component 785 may be a full wave bridge.

Capacitor 780 may be any suitable electrical component for smoothing or evening out fluctuations of a signal. Capacitor 780 may be any suitable type of smoothing capacitor. Capacitor 780 may rectify a variety of current sources and current directions to an output (e.g., to an output of decorative system 710 such as a single DC output). Capacitor 780 may maintain a desired power level. For example, capacitor 780 may maintain a desired power level between a loss or reduction of current power as one or more common power sources change current (e.g., during "fading" and/or "blinking," and/or varying current and/or color levels).

As illustrated in FIG. 5, components of power assembly 705 may be electrically connected to components of decorative system 710 via a plurality of power connectors 734 that may be similar to power connector 135 and/or electrical member 165 and a plurality of connectors 736 that may be similar to connectors 140 and 145.

As illustrated in FIG. 5, decorative system 710 may include a plurality of electrical components 720 that may be similar to electrical components 115, 120, or 125 and a plurality of lighting components 730 that may be similar to lighting components 130. For example, a plurality of lighting components 730 may comprise a dual color LED or incandescent string. Also for example, electrical component 720 may be a single color ornament. Electrical components 720 and lighting components 730 may be electrically connected by any suitable electrical connector such as one or more power connectors 734.

In at least some exemplary embodiments and as illustrated in FIG. 5, incoming power may be transformed from high voltage AC to low voltage DC electricity by electrical component 740. The electrical power may then be passed to control component 775. The electrical power may be transferred to electrical components 720 and lighting components 730 via power connectors 734 based on an operation of converter 750 (e.g., including ornament converter 738 that may include capacitor 780 and electrical bridge component 785). For example, electrical power may be transferred from control component 775 directly to lighting components 730 via respective power connectors 734 as illustrated in FIG. 5. Also for example, electrical power may be transferred from control component 775 to electrical components 720 via ornament converter 738 (e.g., including capacitor 780 and electrical bridge component 785).

In at least some exemplary embodiments and as illustrated in FIG. 5, electrical components 720 may not change color. For example, full wave rectifying of converter 750 may convert the incoming signal in ornament converter 738 with capacitor 780 that keeps the DC electricity output from seeing dips in voltage (e.g., from a "fading" or "blinking" setting of lighting components 730 as controlled by control component 775).

Figure 6:
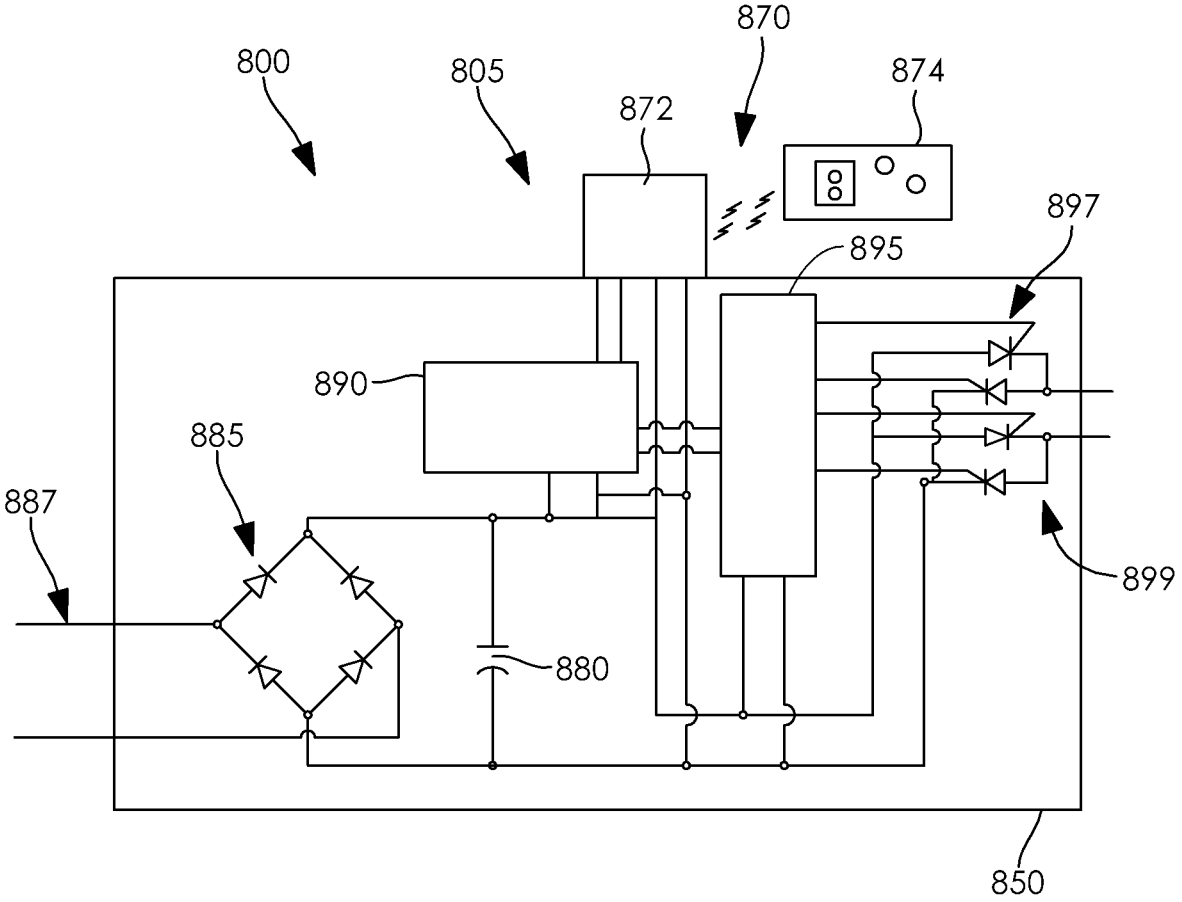
FIG. 6 illustrates a schematic view of at least some exemplary embodiments of the present disclosure.

FIG. 6 schematically illustrates another exemplary embodiment of the exemplary disclosed control and conversion system that may be included in at least some of the exemplary disclosed systems described above. As illustrated in FIG. 6, a system 800 may include one or more power assemblies 805 that may be similar to power assembly 105 that may be electrically connected to a decorative system that may be similar to decorative system 110.

Power assembly 805 may include a converter 850 that may be similar to converter 150. Converter 850 may include a capacitor 880 that may be similar to capacitor 780 and an electrical bridge component 885 that may be similar to electrical bridge component 785.

Converter 850 may also include a selector switch 890. Selector switch 890 may be any suitable type of electronic output selector such as an electronic selector switch box. Converter 850 may further include a driver 895. Driver 895 may be an output driver. Driver 895 may be a driver circuit or a digital output driver.

Driver 895 may be electrically connected to a plurality of output semiconductors (e.g., output semiconductor 897 and output semiconductor 899). Output semiconductor 897 and output semiconductor 899 may be electrically connected to any suitable electrical elements as described above. For example, output semiconductor 897 may be electrically connected to lighting components that may be similar to lighting components 130. Also for example, output semiconductor 899 may be electrically connected to electrical components that may be similar to electrical components 115, 120, and 125. In at least some exemplary embodiments, output semiconductor 899 may be electrically connected to dual color ornaments.

Electrical bridge component 885 may be electrically connected to an input 887 that may be any suitable input for example as described above. For example, electrical bridge component 885 may be electrically connected to a dual color input or any other suitable electrical input. In at least some exemplary embodiments, converter 850 may branch off input 887 that may include a plurality of dual color power cable leads.

Power assembly 805 may also include a controller 870 that may be similar to controller 170. Controller 870 may include a communication component 872 (e.g., a receiver or transceiver) that may wirelessly communicate with a remote control device 874 that may include a user interface for receiving input from a user.

In at least some exemplary embodiments and as illustrated in FIG. 6, input 887 may be an input from a string of dual color LEDs. Electricity may be transferred from input 887 to capacitor 880 via electrical bridge component 885. Capacitor 880 may convert the transferred electrical energy to pure DC electricity. The DC electricity may then be transferred to communication component 872, selector switch 890, driver 895, and output semiconductors 897 and 899. The DC electricity may be transferred to the lighting components and electrical components as described above via output semiconductors 897 and 899.

Figure 7:
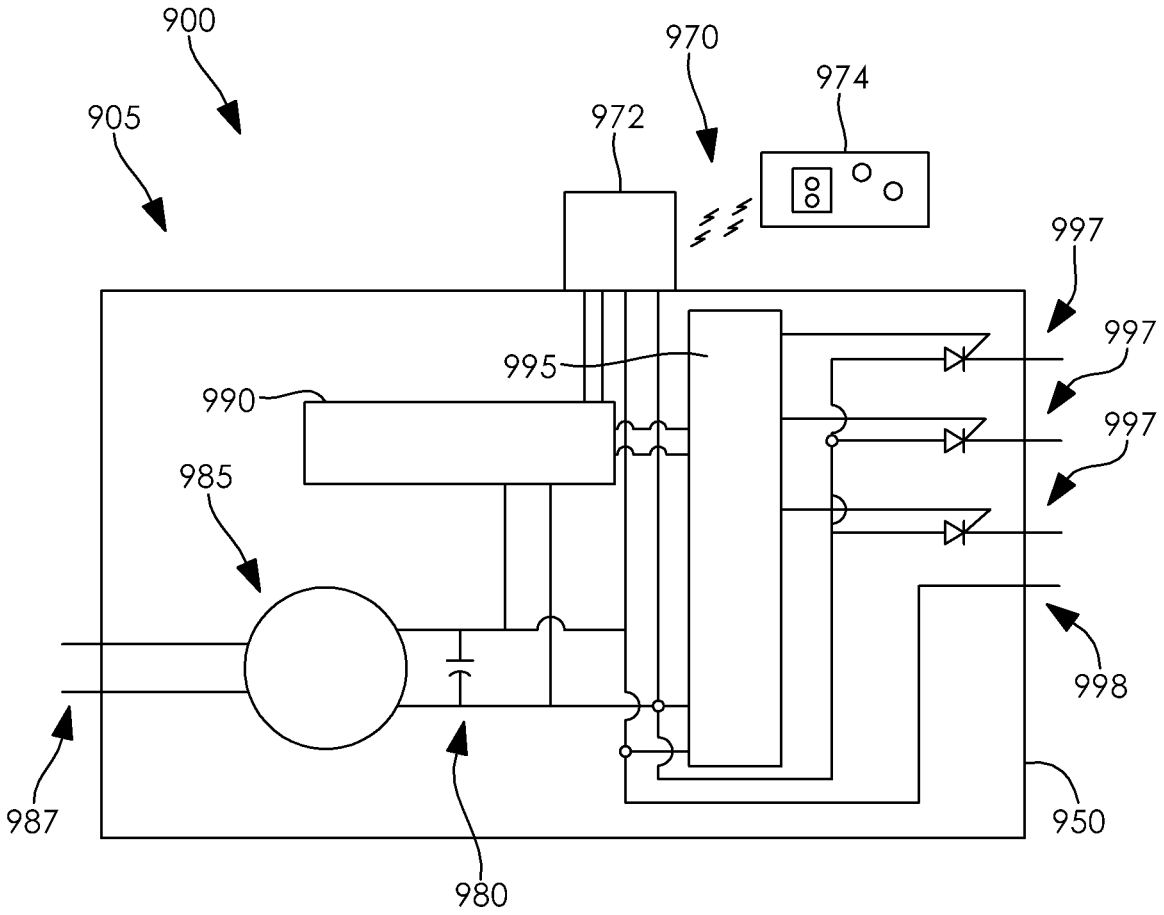
FIG. 7 illustrates a schematic view of at least some exemplary embodiments of the present disclosure.

FIG. 7 schematically illustrates another exemplary embodiment of the exemplary disclosed control and conversion system that may be included in at least some of the exemplary disclosed systems described above. As illustrated in FIG. 7, a system 900 may include one or more power assemblies 905 that may be similar to power assembly 105 that may be electrically connected to a decorative system that may be similar to decorative system 110.

Power assembly 905 may include a converter 950 that may be similar to converter 150. Converter 950 may include a capacitor 980 that may be similar to capacitor 780 and an AC/DC converter 985 that may be any suitable type of converting device (e.g., may be similar to or include a component similar to electrical bridge component 785, or may be any other suitable device for converting electricity between AC and DC).

Converter 950 may also include a selector switch 990 that may be similar to selector switch 890 and a driver 995 that may be similar to driver 895. Driver 995 may be electrically connected to a plurality of output semiconductors 997 that may be similar to output semiconductor 897 and output semiconductor 899. Converter 950 may also include one or more returns 998. Output semiconductors 997 may be electrically connected to any suitable electrical elements as described above. For example, output semiconductors 997 may be selectably connected to lighting components that may be similar to lighting components 130 and/or electrical components that may be similar to electrical components 115, 120, and 125 (e.g., color ornaments). The exemplary disclosed AC/DC converter (e.g., AC/DC converter 985) may be electrically connected to an input 987 that may be similar to input 887. In at least some exemplary embodiments, converter 950 may branch off input 987 that may include a plurality of dual color power cable leads.

Power assembly 905 may also include a controller 970 that may be similar to controller 170 and that may include a communication component 972 that may be similar to communication component 872 and a remote control device 974 that may be similar to remote control device 874.

In at least some exemplary embodiments and as illustrated in FIG. 7, input 987 may be an input from a string of dual color LEDs. Electricity may be transferred from input 987 to capacitor 980 via the exemplary disclosed AC/DC converter (e.g., AC/DC converter 985). Capacitor 980 may convert the electrical energy (e.g., to DC electricity) as described for example herein. The electricity may then be transferred to communication component 972, selector switch 990, driver 995, and output semiconductors 997. The electricity may be transferred to the lighting components and electrical components as described above via output semiconductors 997. Output semiconductors 997 and return 998 may provide for a plurality of color outputs in the exemplary disclosed lighting components and electrical components. It is contemplated that the exemplary disclosed lighting components and electrical components may have one-lead, two-lead, or three-lead power lead configurations to allow each component to have a different illumination display.

Figure 8:
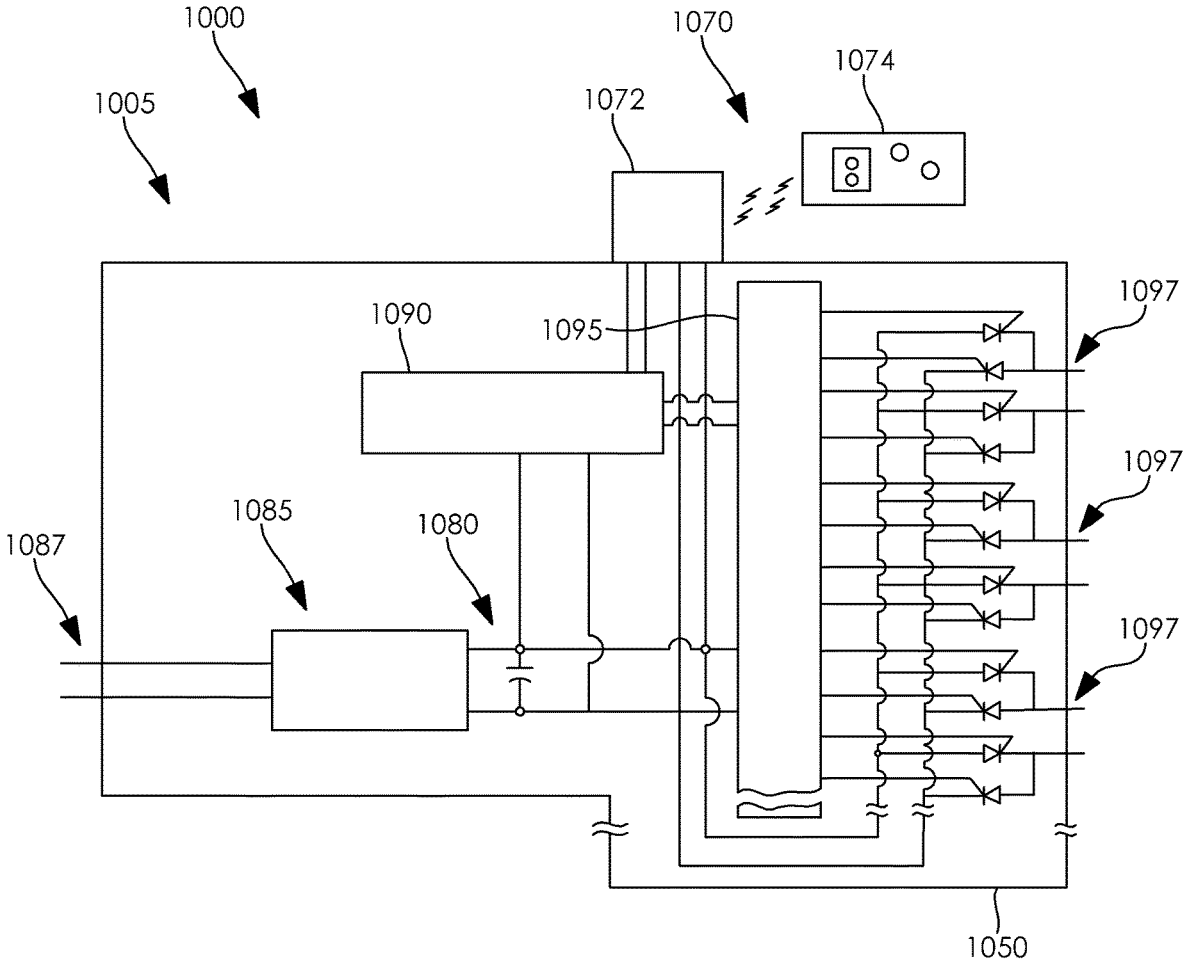
FIG. 8 illustrates a schematic view of at least some exemplary embodiments of the present disclosure.

FIG. 8 schematically illustrates another exemplary embodiment of the exemplary disclosed control and conversion system that may be included in at least some of the exemplary disclosed systems described above. As illustrated in FIG. 8, a system 1000 may include one or more power assemblies 1005 that may be similar to power assembly 105 that may be electrically connected to a decorative system that may be similar to decorative system 110.

Power assembly 1005 may include a converter 1050 that may be similar to converter 150. Converter 1050 may include a capacitor 1080 that may be similar to capacitor 780 and an AC/DC converter 1085 that may be similar to AC/DC converter 985.

Converter 1050 may also include a selector switch 1090 that may be similar to selector switch 890 and a driver 1095 that may be similar to driver 895. Driver 1095 may be electrically connected to a plurality of output semiconductors 1097 that may be similar to output semiconductor 897 and output semiconductor 899. Output semiconductors 1097 may be electrically connected to any suitable electrical elements as described above. For example, output semiconductors 1097 may be selectably connected to lighting components that may be similar to lighting components 130 and/or electrical components that may be similar to electrical components 115, 120, and 125 (e.g., color ornaments). The exemplary disclosed AC/DC converter (e.g., AC/DC converter 1085) may be electrically connected to an input 1087 that may be similar to input 887. In at least some exemplary embodiments, converter 1050 may branch off input 1087 that may include a plurality of dual color power cable leads.

Power assembly 1005 may also include a controller 1070 that may be similar to controller 170 and that may include a communication component 1072 that may be similar to communication component 872 and a remote control device 1074 that may be similar to remote control device 874.

In at least some exemplary embodiments and as illustrated in FIG. 8, input 1087 may be an input from a string of dual color LEDs. Electricity may be transferred from input 1087 to capacitor 1080 via the exemplary disclosed AC/DC converter (e.g., AC/DC converter 1085). Capacitor 1080 may convert the electrical energy (e.g., to DC electricity) as described for example herein. The electricity may then be transferred to communication component 1072, selector switch 1090, driver 1095, and output semiconductors 1097. The electricity may be transferred to the lighting components and electrical components as described above via output semiconductors 1097. Output semiconductors 1097 may provide for a plurality of color outputs in the exemplary disclosed lighting components and electrical components.

In at least some exemplary embodiments, output semiconductors 1097 may include separate outputs (e.g., three separate outputs) with each output having a reversing capability of current directions. This exemplary configuration may allow for multiple dual color LEDs in the exemplary disclosed lighting components and electrical components to provide independent illumination of ornaments. The exemplary disclosed ornaments (e.g., similar to electrical components 115, 120, and 125) may include one or more outputs, providing for a relatively large variety of color combinations (e.g., 6-color or any other desired number).

Figure 9:
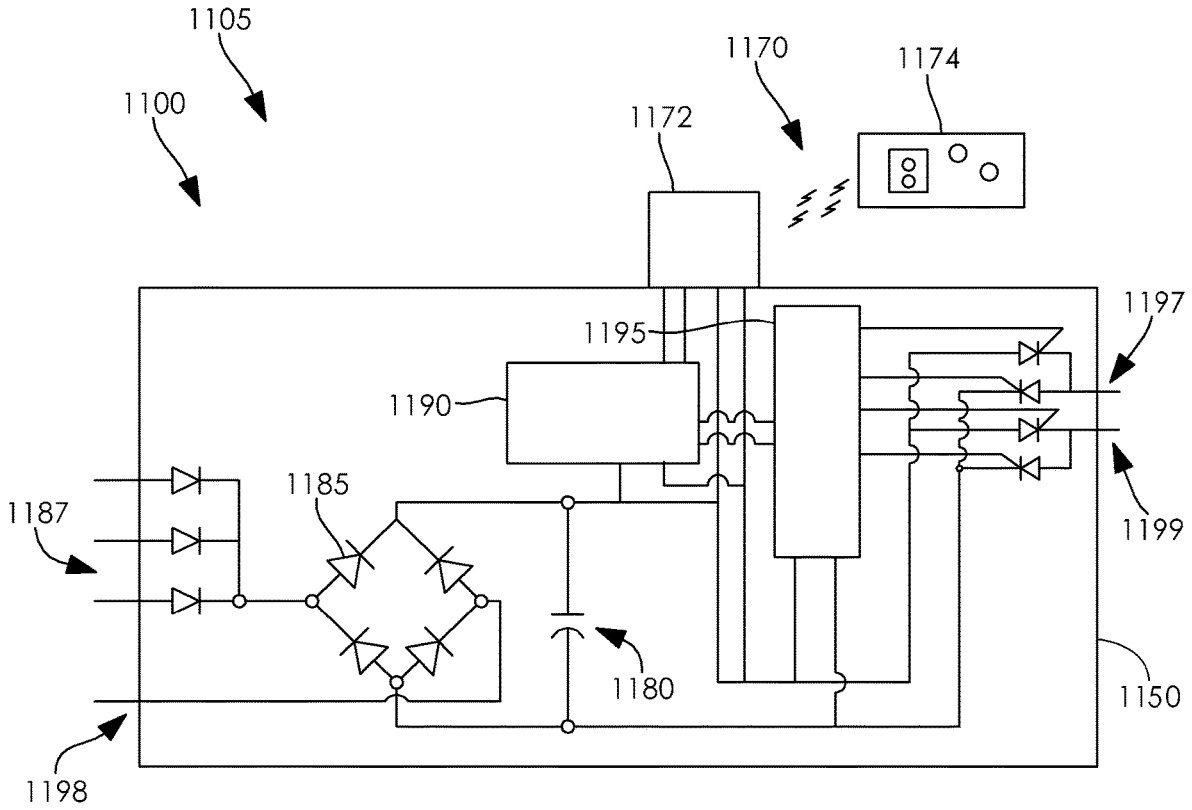
FIG. 9 illustrates a schematic view of at least some exemplary embodiments of the present disclosure.

FIG. 9 schematically illustrates another exemplary embodiment of the exemplary disclosed control and conversion system that may be included in at least some of the exemplary disclosed systems described above. As illustrated in FIG. 9, a system 1100 may include one or more power assemblies 1105 that may be similar to power assembly 105 that may be electrically connected to a decorative system that may be similar to decorative system 110.

Power assembly 1105 may include a converter 1150 that may be similar to converter 150. Converter 1150 may include a capacitor 1180 that may be similar to capacitor 780 and an electrical bridge component 1185 (e.g., an AC/DC bridge) that may be similar to electrical bridge component 785.

Converter 1150 may also include a selector switch 1190 that may be similar to selector switch 890 and a driver 1195 that may be similar to driver 895.

Driver 1195 may be electrically connected to a plurality of output semiconductors (e.g., output semiconductor 1197 and output semiconductor 1199). Output semiconductor 1197 and output semiconductor 1199 may be electrically connected to any suitable electrical elements as described above. For example, output semiconductors 1197 and 1199 may be electrically connected to lighting components that may be similar to lighting components 130 and/or electrical components that may be similar to electrical components 115, 120, and 125. In at least some exemplary embodiments, output semiconductor 1197 and/or output semiconductor 1199 may be electrically connected to dual color ornaments.

Electrical bridge component 1185 may be electrically connected to an input 1187 that may be any suitable input for example as described above. For example, electrical bridge component 1185 may be electrically connected to one or more of the three color inputs of a 3-LED one-return lead LED string cable. Electrical bridge component 1185 may also be connected to a return 1198 (e.g., a common return).

Power assembly 1105 may also include a controller 1170 that may be similar to controller 170. Controller 1170 may include a communication component 1172 that may be similar to communication component 872 and a remote control device 1174 that may be similar to remote control device 874.

In at least some exemplary embodiments and as illustrated in FIG. 9, electricity may be transferred from input 1187 to capacitor 1180 via electrical bridge component 1185. Capacitor 1180 may convert the electrical energy (e.g., to pure DC electricity). The electricity may then be transferred to communication component 1172, selector switch 1190, driver 1195, and output semiconductors 1197 and 1199. The DC electricity may be transferred to the lighting components and electrical components as described above via output semiconductors 1197 and 1199. In at least some exemplary embodiments, converter 1150 may provide for two output leads (e.g., output semiconductors 1197 and 1199) with a reversing current capability for providing a dual color capability in the exemplary disclosed lighting components and electrical components (e.g., ornaments). System 1100 may provide for independent or individual color selections for each individual ornament.

Figure 10:
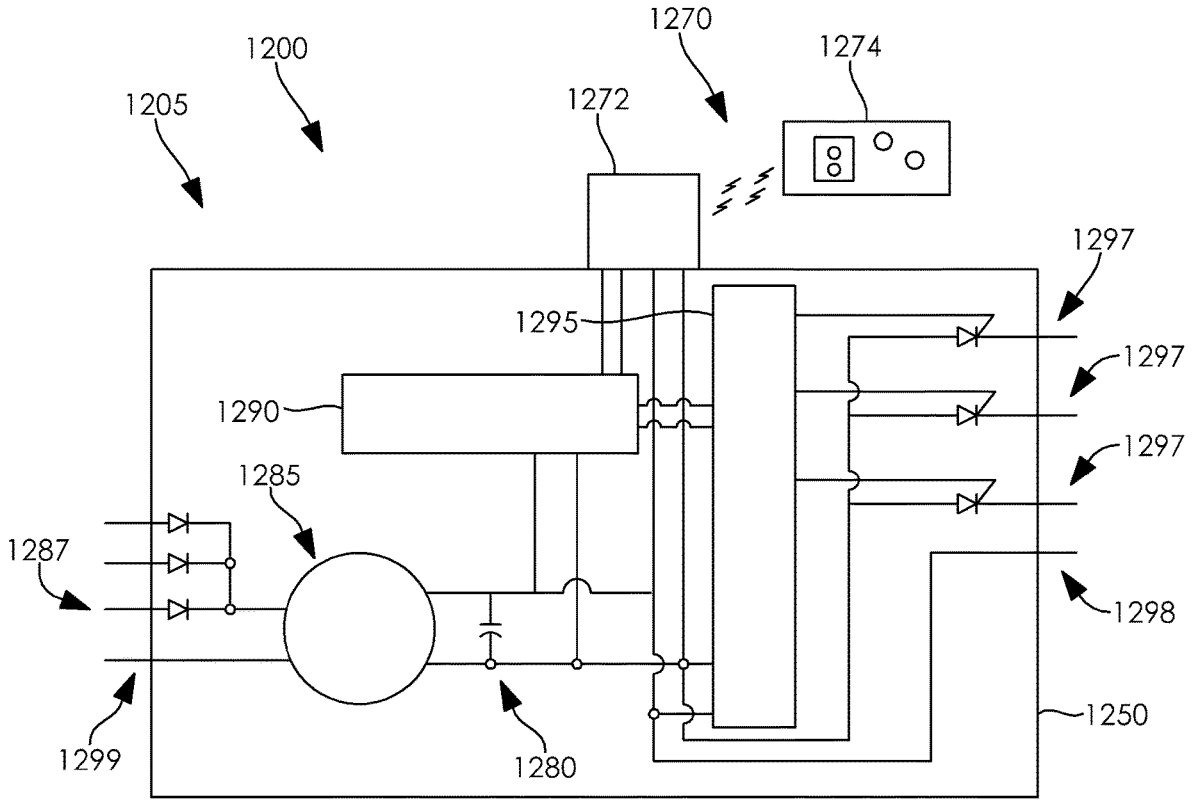
FIG. 10 illustrates a schematic view of at least some exemplary embodiments of the present disclosure.

FIG. 10 schematically illustrates another exemplary embodiment of the exemplary disclosed control and conversion system that may be included in at least some of the exemplary disclosed systems described above. As illustrated in FIG. 10, a system 1200 may include one or more power assemblies 1205 that may be similar to power assembly 105 that may be electrically connected to a decorative system that may be similar to decorative system 110.

Power assembly 1205 may include a converter 1250 that may be similar to converter 150. Converter 1250 may include a capacitor 1280 that may be similar to capacitor 780 and an AC/DC converter 1285 that may be similar to AC/DC converter 985.

Converter 1250 may also include a selector switch 1290 that may be similar to selector switch 890 and a driver 1295 that may be similar to driver 895. Driver 1295 may be electrically connected to a plurality of output semiconductors 1297 that may be similar to output semiconductor 897 and output semiconductor 899. Converter 1250 may also include one or more returns 1298. Output semiconductors 1297 may be electrically connected to any suitable electrical elements as described above. For example, output semiconductors 1297 may be selectably connected to lighting components that may be similar to lighting components 130 and/or electrical components that may be similar to electrical components 115, 120, and 125 (e.g., color ornaments).

AC/DC converter 1285 may be electrically connected to an input 1287 that may be any suitable input for example as described above. For example, AC/DC converter 1285 may be electrically connected to one or more of the three color inputs of a 3-LED one-return lead LED string cable. AC/DC converter 1285 may also be connected to a return 1299 (e.g., a common return).

Power assembly 1205 may also include a controller 1270 that may be similar to controller 170 and that may include a communication component 1272 that may be similar to communication component 872 and a remote control device 1274 that may be similar to remote control device 874.

System 1200 may operate similarly to as described above regarding FIG. 7 for output (e.g., three output semiconductors 1297 and common return 1298), which may provide for a plurality of display colors. System 1200 may operate similarly to as described above regarding FIG. 9 for input (e.g., input 1287 and common return 1298).

Figure 11:
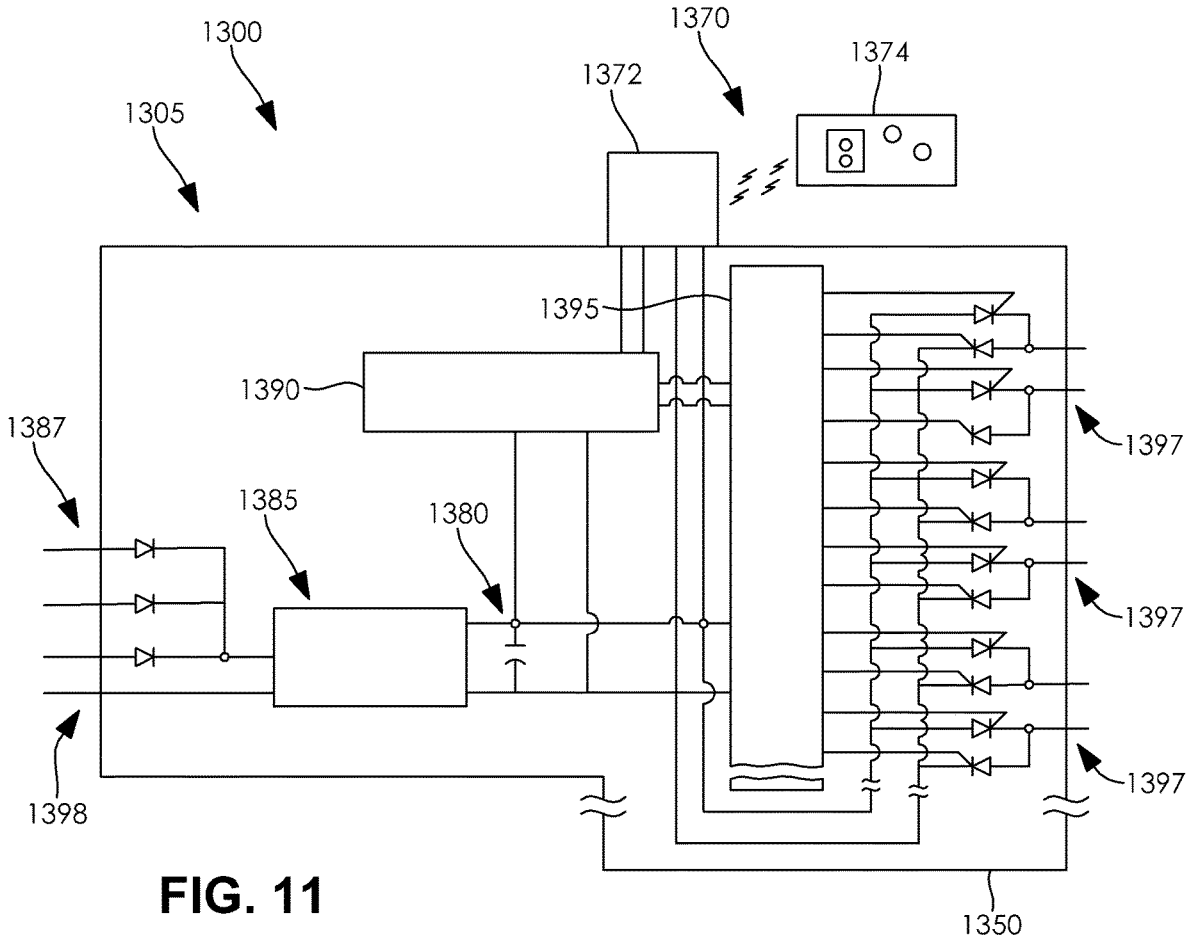
FIG. 11 illustrates a schematic view of at least some exemplary embodiments of the present disclosure.

FIG. 11 schematically illustrates another exemplary embodiment of the exemplary disclosed control and conversion system that may be included in at least some of the exemplary disclosed systems described above. As illustrated in FIG. 11, a system 1300 may include one or more power assemblies 1305 that may be similar to power assembly 105 that may be electrically connected to a decorative system that may be similar to decorative system 110.

Power assembly 1305 may include a converter 1350 that may be similar to converter 150. Converter 1350 may include a capacitor 1380 that may be similar to capacitor 780 and an AC/DC converter 1385 that may be similar to AC/DC converter 985.

Converter 1350 may also include a selector switch 1390 that may be similar to selector switch 890 and a driver 1395 that may be similar to driver 895. Driver 1395 may be electrically connected to a plurality of output semiconductors 1397 that may be similar to output semiconductor 897 and output semiconductor 899. Output semiconductors 1397 may be electrically connected to any suitable electrical elements as described above. For example, output semiconductors 1397 may be selectably connected to lighting components that may be similar to lighting components 130 and/or electrical components that may be similar to electrical components 115, 120, and 125 (e.g., color ornaments).

AC/DC converter 1385 may be electrically connected to an input 1387 that may be any suitable input for example as described above. For example, AC/DC converter 1385 may be electrically connected to one or more of the three color inputs of a 3-LED one-return lead LED string cable. AC/DC converter 1385 may also be connected to a return 1398 (e.g., a common return).

Power assembly 1305 may also include a controller 1370 that may be similar to controller 170 and that may include a communication component 1372 that may be similar to communication component 872 and a remote control device 1374 that may be similar to remote control device 874.

In at least some exemplary embodiments and as illustrated in FIG. 11, electricity may be transferred from input 1387 to capacitor 1380 via the exemplary disclosed AC/DC converter (e.g., AC/DC converter 1385). Capacitor 1380 may convert the electrical energy (e.g., to DC electricity) as described for example herein. The electricity may then be transferred to communication component 1372, selector switch 1390, driver 1395, and output semiconductors 1397. The electricity may be transferred to the lighting components and electrical components as described above via output semiconductors 1397. Output semiconductors 1397 may provide for a plurality of color outputs in the exemplary disclosed lighting components and electrical components.

System 1300 may operate similarly to as described above regarding FIG. 10 for input (e.g., input 1387 and common return 1398). In at least some exemplary embodiments, output semiconductors 1397 may include separate outputs (e.g., three separate outputs) with each output having a reversing capability of current directions. This exemplary configuration may allow for multiple dual color LEDs in the exemplary disclosed lighting components and electrical components to provide independent illumination of ornaments. The exemplary disclosed ornaments (e.g., similar to electrical components 115, 120, and 125) may include one or more outputs, providing for a relatively large variety of color combinations (e.g., 6-color or any other desired number).

In at least some exemplary embodiments, the exemplary disclosed apparatus may include a controller, a main power source, an electrical converter configured to receive a first electrical signal from the main power source, and a capacitor (e.g., portion of converter 150, portion of converter 350, portion of converter 450, portion of converter 550, portion of converter 650, capacitor 780, capacitor 880, capacitor 980, capacitor 1080, capacitor 1180, capacitor 1280, or capacitor 1380) electrically connected to the electrical converter. The exemplary disclosed apparatus may also include an electrical selector switch electrically connected to at least one of the electrical converter and the capacitor, an electrical driver electrically connected to the electrical selector switch, at least one electrical output component electrically connected to the electrical driver, and at least one electrical component that is configured to receive a second electrical signal via the at least one electrical output component. The controller may control an operation of the at least one electrical component based on the second electrical signal, independently of control of the first electrical signal. The electrical converter and the capacitor may be configured to convert the first electrical signal to the second electrical signal. The first electrical signal may be an AC electrical signal and the second electrical signal may be a DC electrical signal that is evened out by the capacitor that is a smoothing capacitor. The main power source may be a dual color LED light string. The main power source may include at least one of three color inputs of a 3-LED one-return lead LED string cable. The electrical converter may be an AC/DC converter or a full wave bridge. The main power source may be an incandescent light string. The at least one electrical component may be selected from the group consisting of a dual color LED string, a holiday ornament including an LED, and an incandescent light string. The main power source may include an AC/DC, HI/LO adapter. The main power source may include a foot pedal switch, the foot pedal switch being disposed between the AC/DC, HI/LO adapter and the electrical converter.

In at least some exemplary embodiments, the exemplary disclosed method may include providing a first electrical signal from a main power source to an electrical converter, converting the first electrical signal to a second electrical signal using the electrical converter, smoothing the second electrical signal using a capacitor (e.g., portion of converter 150, portion of converter 350, portion of converter 450, portion of converter 550, portion of converter 650, capacitor 780, capacitor 880, capacitor 980, capacitor 1080, capacitor 1180, capacitor 1280, or capacitor 1380) electrically connected to the electrical converter, and transferring the smoothed second electrical signal to at least one electrical output component via an electrical selector switch electrically connected to the capacitor and via an electrical driver electrically connected to the electrical selector switch. The exemplary disclosed method may also include transferring the smoothed second electrical signal to at least one electrical component via the at least one electrical output component, controlling the first electrical signal, and controlling an operation of the at least one electrical component based on the smoothed second electrical signal, independently of controlling the first electrical signal. Smoothing the second electrical signal includes eliminating dips caused by fading or blinking of lighting components of the main power source. The first electrical signal may be an AC electrical signal and the second electrical signal may be a DC electrical signal. Controlling the first electrical signal may include using an electrical switch electrically connected to the main power source. The exemplary disclosed method may include connecting an AC/DC, HI/LO adapter included in the main power source to a wall socket.

In at least some exemplary embodiments, the exemplary disclosed apparatus may include a controller, a main light string, an electrical converter configured to receive a first electrical signal from the main light string, a smoothing capacitor (e.g., portion of converter 150, portion of converter 350, portion of converter 450, portion of converter 550, portion of converter 650, capacitor 780, capacitor 880, capacitor 980, capacitor 1080, capacitor 1180, capacitor 1280, or capacitor 1380) electrically connected to the electrical converter, and an electrical selector switch electrically connected to at least one of the electrical converter and the smoothing capacitor. The exemplary disclosed apparatus may also include an electrical driver electrically connected to the electrical selector switch, at least one output semiconductor electrically connected to the electrical driver, and at least one LED string and at least one LED holiday ornament that are configured to receive a second electrical signal via the at least one output semiconductor. The controller may control an operation of the at least one LED string and the at least one LED holiday ornament based on the second electrical signal, independently of control of the first electrical signal. The at least one LED string and the at least one LED holiday ornament may be disposed on an artificial tree. The first electrical signal may be an AC electrical signal and the second electrical signal may be a DC electrical signal that is evened out by the smoothing capacitor. The main light string may be an LED light string or an incandescent light string. The main light string may include a foot pedal switch and an AC/DC, HI/LO adapter.

The exemplary disclosed system, apparatus, and method may be used in any suitable application for providing lighting. The exemplary disclosed system, apparatus, and method may be used in any suitable application for providing decorative lighting such as, for example, holiday lighting. For example, the exemplary disclosed system, apparatus, and method may be used in any suitable lighting control application involving main lighting sources such as lighting strings.

The exemplary disclosed system, apparatus, and method may provide an efficient and effective technique for controlling a lighting system. For example, the exemplary disclosed system, apparatus, and method may provide an efficient and effective technique for powering lights using a main lighting source such as a main lighting string while allowing independent operation and control of the lights. Also for example, the exemplary disclosed system, apparatus, and method may provide illuminated decorative ornaments to be powered by a main lighting string while allowing for independent control of the lighting of the ornaments. The exemplary disclosed system, apparatus, and method may provide a plurality or multiplicity of illuminated displays to a seasonal decoration using a single LED light string.

In the Summary above and in this Detailed Description, and the claims below, and in the accompanying drawings, reference is made to particular features of various embodiments of the invention. It is to be understood that the disclosure of embodiments of the invention in this specification includes all possible combinations of such particular features. For example, where a particular feature is disclosed in the context of a particular aspect or embodiment of the invention, or a particular claim, that feature can also be used—to the extent possible—in combination with and/or in the context of other particular aspects and embodiments of the invention, and in the invention generally.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

In the present disclosure, various features may be described as being optional, for example, through the use of the verb "may;", or, through the use of any of the phrases: "in some embodiments," "in some implementations," "in some designs," "in various embodiments," "in various implementations,", "in various designs," "in an illustrative example," or "for example;" or, through the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be embodied in seven different ways, namely with just one of the three possible features, with any two of the three possible features or with all three of the three possible features.

In various embodiments. elements described herein as coupled or connected may have an effectual relationship realizable by a direct connection or indirectly with one or more other intervening elements.

In the present disclosure, the term "any" may be understood as designating any number of the respective elements, i.e. as designating one, at least one, at least two, each or all of the respective elements. Similarly, the term "any" may be understood as designating any collection(s) of the respective elements, i.e. as designating one or more collections of the respective elements, a collection comprising one, at least one, at least two, each or all of the respective elements. The respective collections need not comprise the same number of elements.

While various embodiments of the present invention have been disclosed and described in detail herein, it will be apparent to those skilled in the art that various changes may be made to the configuration, operation and form of the invention without departing from the spirit and scope thereof. In particular, it is noted that the respective features of embodiments of the invention, even those disclosed solely in combination with other features of embodiments of the invention, may be combined in any configuration excepting those readily apparent to the person skilled in the art as nonsensical. Likewise, use of the singular and plural is solely for the sake of illustration and is not to be interpreted as limiting.

In the present disclosure, all embodiments where "comprising" is used may have as alternatives "consisting essentially of," or "consisting of." In the present disclosure, any method or apparatus embodiment may be devoid of one or more process steps or components. In the present disclosure, embodiments employing negative limitations are expressly disclosed and considered a part of this disclosure.

Certain terminology and derivations thereof may be used in the present disclosure for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "comprises" and grammatical equivalents thereof are used herein to mean that other components, ingredients, steps, among others, are optionally present. For example, an embodiment "comprising" (or "which comprises") components A, B and C can consist of (i.e., contain only) components A, B and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose limit is the second number. For example, 25 to 100 mm means a range whose lower limit is 25 mm and upper limit is 100 mm.

Many suitable methods and corresponding materials to make each of the individual parts of embodiment apparatus are known in the art. According to an embodiment of the present invention, one or more of the parts may be formed by machining, 3D printing (also known as "additive" manufacturing), CNC machined parts (also known as "subtractive" manufacturing), and injection molding, as will be apparent to a person of ordinary skill in the art. Metals, wood, thermoplastic and thermosetting polymers, resins and elastomers as may be described herein-above may be used. Many suitable materials are known and available and can be selected and mixed depending on desired strength and flexibility, preferred manufacturing method and particular use, as will be apparent to a person of ordinary skill in the art.

Any element in a claim herein that does not explicitly state "means for" performing a specified function, or "step for" performing a specific function, is not to be interpreted as a "means" or "step" clause as specified in 35 U.S.C. § 112 (f). Specifically, any use of "step of" in the claims herein is not intended to invoke the provisions of 35 U.S.C. § 112 (f).

According to an embodiment of the present invention, the system and method may be accomplished through the use of one or more computing devices. One of ordinary skill in the art would appreciate that an exemplary system appropriate for use with embodiments in accordance with the present application may generally include one or more of a Central processing Unit (CPU), Random Access Memory (RAM), a storage medium (e.g., hard disk drive, solid state drive, flash memory, cloud storage), an operating system (OS), one or more application software, a display element, one or more communications means, or one or more input/output devices/means. Examples of computing devices usable with embodiments of the present invention include, but are not limited to, proprietary computing devices, personal computers, mobile computing devices, tablet PCs, mini-PCs, servers or any combination thereof. The term computing device may also describe two or more computing devices communicatively linked in a manner as to distribute and share one or more resources, such as clustered computing devices and server banks/farms. One of ordinary skill in the art would understand that any number of computing devices could be used, and embodiments of the present invention are contemplated for use with any computing device.

In various embodiments, communications means, data store(s), processor(s), or memory may interact with other components on the computing device, in order to effect the provisioning and display of various functionalities associated with the system and method detailed herein. One of ordinary skill in the art would appreciate that there are numerous configurations that could be utilized with embodiments of the present invention, and embodiments of the present invention are contemplated for use with any appropriate configuration.

According to an embodiment of the present invention, the communications means of the system may be, for instance, any means for communicating data over one or more networks or to one or more peripheral devices attached to the system. Appropriate communications means may include, but are not limited to, circuitry and control systems for providing wireless connections, wired connections, cellular connections, data port connections, Bluetooth connections, or any combination thereof. One of ordinary skill in the art would appreciate that there are numerous communications means that may be utilized with embodiments of the present invention, and embodiments of the present invention are contemplated for use with any communications means.

Throughout this disclosure and elsewhere, block diagrams and flowchart illustrations depict methods, apparatuses (i.e., systems), and computer program products. Each element of the block diagrams and flowchart illustrations, as well as each respective combination of elements in the block diagrams and flowchart illustrations, illustrates a function of the methods, apparatuses, and computer program products. Any and all such functions ("disclosed functions") can be implemented by computer program instructions; by special-purpose, hardware-based computer systems; by combinations of special purpose hardware and computer instructions; by combinations of general purpose hardware and computer instructions; and so on—any and all of which may be generally referred to herein as a "circuit," "module," or "system."

While the foregoing drawings and description may set forth functional aspects of the disclosed systems, no particular arrangement of software for implementing these functional aspects should be inferred from these descriptions unless explicitly stated or otherwise clear from the context.

Each element in flowchart illustrations may depict a step, or group of steps, of a computer-implemented method. Further, each step may contain one or more sub-steps. For the purpose of illustration, these steps (as well as any and all other steps identified and described above) are presented in order. It will be understood that an embodiment can contain an alternate order of the steps adapted to a particular application of a technique disclosed herein. All such variations and modifications are intended to fall within the scope of this disclosure. The depiction and description of steps in any particular order is not intended to exclude embodiments having the steps in a different order, unless required by a particular application, explicitly stated, or otherwise clear from the context.

Traditionally, a computer program consists of a sequence of computational instructions or program instructions. It will be appreciated that a programmable apparatus (i.e., computing device) can receive such a computer program and, by processing the computational instructions thereof, produce a further technical effect.

A programmable apparatus may include one or more microprocessors, microcontrollers, embedded microcontrollers, programmable digital signal processors, programmable devices, programmable gate arrays, programmable array logic, memory devices, application specific integrated circuits, or the like, which can be suitably employed or configured to process computer program instructions, execute computer logic, store computer data, and so on. Throughout this disclosure and elsewhere a computer can include any and all suitable combinations of at least one general purpose computer, special-purpose computer, programmable data processing apparatus, processor, processor architecture, and so on.

It will be understood that a computer can include a computer-readable storage medium and that this medium may be internal or external, removable and replaceable, or fixed. It will also be understood that a computer can include a Basic Input/Output System (BIOS), firmware, an operating system, a database, or the like that can include, interface with, or support the software and hardware described herein.

Embodiments of the system as described herein are not limited to applications involving conventional computer programs or programmable apparatuses that run them. It is contemplated, for example, that embodiments of the invention as claimed herein could include an optical computer, quantum computer, analog computer, or the like.

Regardless of the type of computer program or computer involved, a computer program can be loaded onto a computer to produce a particular machine that can perform any and all of the disclosed functions. This particular machine provides a means for carrying out any and all of the disclosed functions.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

In some embodiments, computer program instructions may be stored in a computer-readable memory capable of directing a computer or other programmable data processing apparatus to function in a particular manner. The instructions stored in the computer-readable memory constitute an article of manufacture including computer-readable instructions configured to implement any and all of the disclosed functions.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

The elements depicted in flowchart illustrations and block diagrams throughout the figures imply logical boundaries between the elements. However, according to software or hardware engineering practices, the disclosed elements and the functions thereof may be implemented as parts of a monolithic software structure, as standalone software modules, or as modules that employ external routines, code, services, and so forth, or any combination of these. All such implementations are within the scope of the present disclosure.

Unless explicitly stated or otherwise clear from the context, the verbs "execute" and "process" are used interchangeably to indicate execute, process, interpret, compile, assemble, link, load, any and all combinations of the foregoing, or the like. Therefore, embodiments that execute or process computer program instructions, computer-executable code, or the like can suitably act upon the instructions or code in any and all of the ways just described.

The functions and operations presented herein are not inherently related to any particular computer or other apparatus. Various general-purpose systems may also be used with programs in accordance with the teachings herein, or it may prove convenient to construct more specialized apparatus to perform the required method steps. The required structure for a variety of these systems will be apparent to those of skill in the art, along with equivalent variations. In addition, embodiments of the invention are not described with reference to any particular programming language. It is appreciated that a variety of programming languages may be used to implement the present teachings as described herein, and any references to specific languages are provided for disclosure of enablement and best mode of embodiments of the invention. Embodiments of the invention are well suited to a wide variety of computer network systems over numerous topologies. Within this field, the configuration and management of large networks include storage devices and computers that are communicatively coupled to dissimilar computers and storage devices over a network, such as the Internet.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. An apparatus, comprising:

a controller;

a first light string that is a main light string;

an electrical converter that is connected by a plurality of electrical connectors to the first light string and configured to receive a first electrical signal from the first light string via the plurality of electrical connectors;

a capacitor electrically connected to the electrical converter;

an electrical selector switch electrically connected to at least one of the electrical converter and the capacitor;

an electrical driver electrically connected to the electrical selector switch;

at least one electrical output component electrically connected to the electrical driver; and a second light string that is configured to receive a second electrical signal via the at least one electrical output component;

wherein the controller controls an operation of the second light string based on the second electrical signal, independently of control of the first electrical signal; and wherein the electrical converter is electrically disposed between the first light string and the second light string.

2. The apparatus of claim 1, wherein:

the electrical converter and the capacitor are configured to convert the first electrical signal of the first light string to the second electrical signal of the second light string; and the electrical selector switch and the electrical driver are electrically disposed between the second light string and both the electrical converter and the capacitor.

3. The apparatus of claim 2, wherein the first electrical signal is an AC electrical signal and the second electrical signal is a DC electrical signal that is evened out by the capacitor that is a smoothing capacitor.

4. The apparatus of claim 1, wherein:

the first light string is a dual color LED light string; and the electrical converter separates a first portion and a second portion of the first light string, the electrical converter electrically connecting the first and second portions of the first light string via the plurality of electrical connectors.

5. The apparatus of claim 1, wherein:

the first light string includes at least one of three color inputs of a 3-LED one-return lead LED string cable; and the electrical converter separates the first light string from the second light string.

6. The apparatus of claim 1, wherein:

the electrical converter is an AC/DC converter or a full wave bridge; and the electrical selector switch, the electrical driver, and the at least one electrical output component are electrically disposed between the second light string and both the electrical converter and the capacitor.

7. The apparatus of claim 1, wherein the first light string is an incandescent light string.

8. The apparatus of claim 1, wherein the second light string is selected from the group consisting of a dual color LED string, a holiday ornament including an LED, and an incandescent light string.

9. The apparatus of claim 1, wherein:

the first light string includes an AC/DC, HI/LO adapter; and the electrical converter and the second light string are integral parts of an electrical component that is connected to the first light string via the plurality of electrical connectors.

10. The apparatus of claim 9, wherein the first light string includes a foot pedal switch, the foot pedal switch being electrically disposed between the AC/DC, HI/LO adapter and the electrical converter.

11. A method, comprising:

providing a first electrical signal from a first light string to an electrical converter;

converting the first electrical signal to a second electrical signal using the electrical converter;

smoothing the second electrical signal using a capacitor electrically connected to the electrical converter;

transferring the smoothed second electrical signal to at least one electrical output component via an electrical selector switch electrically connected to the capacitor and via an electrical driver electrically connected to the electrical selector switch;

transferring the smoothed second electrical signal to a second light string via the at least one electrical output component, wherein the second light string is different from the first light string;

controlling the first light string based on the first electrical signal;

controlling an operation of the second light string based on the smoothed second electrical signal, independently of controlling the first light string based on the first electrical signal; and electrically disposing the electrical converter between the first light string and the second light string.

12. The method of claim 11, wherein:

smoothing the second electrical signal includes eliminating dips caused by fading or blinking of lighting components of the first light string; and all of the electrical converter, the electrical selector switch, the electrical driver, the capacitor, and the at least one electrical output component are electrically disposed between the first light string and the second light string.

13. The method of claim 11, wherein the first electrical signal of the first light string is an AC electrical signal and the second electrical signal of the second light string is a DC electrical signal.

14. The method of claim 11, wherein controlling the first electrical signal includes using an electrical switch electrically connected to the first light string.

15. The method of claim 11, further comprising connecting an AC/DC, HI/LO adapter included in the first light string to a wall socket.

16. An apparatus, comprising:

a remote controller;

a main light string;

an electrical converter that is connected by a plurality of electrical connectors to the main light string and that is configured to receive a first electrical signal from the main light string;

a smoothing capacitor electrically connected to the electrical converter;

an electrical selector switch electrically connected to at least one of the electrical converter and the smoothing capacitor;

an electrical driver electrically connected to the electrical selector switch;

at least one output semiconductor electrically connected to the electrical driver; and at least one LED string and at least one LED holiday ornament that are configured to receive a second electrical signal via the at least one output semiconductor, the electrical converter being electrically disposed between the main light string and both the at least one LED string and the at least one LED holiday ornament, the electrical converter separating the main light string from both the at least one LED string and the at least one LED holiday ornament;

wherein the remote controller is remotely located from the apparatus and remotely controls an operation of the at least one LED string and the at least one LED holiday ornament based on the second electrical signal, independently of control of the first electrical signal.

17. The apparatus of claim 16, wherein:

the at least one LED string and the at least one LED holiday ornament are disposed on an artificial tree;

the electrical converter separates a first portion and a second portion of the main light string, the electrical converter electrically connecting the first and second portions of the main light string via the plurality of electrical connectors; and the electrical converter and both the at least one LED string and the at least one LED holiday ornament are integral parts of an electrical component that is connected to the main light string via the plurality of electrical connectors.

18. The apparatus of claim 16, wherein the first electrical signal is an AC electrical signal and the second electrical signal is a DC electrical signal that is evened out by the smoothing capacitor.

19. The apparatus of claim 16, wherein:

the main light string is an LED light string or an incandescent light string that is different electrical component from both the at least one LED string and the at least one LED holiday ornament; and the electrical driver is electrically disposed between the electrical selector switch and both the at least one LED string and the at least one LED holiday ornament.

20. The apparatus of claim 16, wherein:

the main light string includes a foot pedal switch and an AC/DC, HI/LO adapter;

the at least one output semiconductor is electrically connected in series with the at least one LED string; and the at least one output semiconductor is electrically connected in series with the at least one LED holiday ornament.

* * * * *